US011708974B2

(12) United States Patent
Versailles et al.

(10) Patent No.: US 11,708,974 B2
(45) Date of Patent: Jul. 25, 2023

(54) PREMIXER INJECTOR ASSEMBLY IN GAS TURBINE ENGINE

(71) Applicant: Siemens Energy Global GmbH & Co. KG, Munich (DE)

(72) Inventors: Philippe Versailles, Mascouche (CA); Graeme Watson, Montreal (CA); Marc Furi, Dorval (CA)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/997,664

(22) PCT Filed: Jul. 17, 2020

(86) PCT No.: PCT/US2020/042489

§ 371 (c)(1),
(2) Date: Nov. 1, 2022

(87) PCT Pub. No.: WO2022/015321

PCT Pub. Date: Jan. 20, 2022

(65) Prior Publication Data

US 2023/0130173 A1 Apr. 27, 2023

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC .... F23R 3/14; F23R 3/28; F23R 3/283; F23R 3/286
See application file for complete search history.

(56) References Cited

U.S. PATENT DOCUMENTS 4,315,603 A * 2/1982 Nakajima ..... F02M 61/161 239/533.9
7,568,345 B2 8/2009 Furletov et al.
8,220,271 B2 * 7/2012 Poyyapakkam ..... F23R 3/28 60/737
10,415,833 B2 * 9/2019 Kapilavai ..... F23R 3/46
(Continued)

FOREIGN PATENT DOCUMENTS

EP 1865261 A2 12/2007

OTHER PUBLICATIONS

PCT International Search Report and Written Opinion of International Searching Authority dated Apr. 6, 2021 corresponding to PCT International Application No. PCT/US2020/042489 filed Jul. 17, 2020.

*Primary Examiner* — William H Rodriguez

(57) ABSTRACT

A premixer injector assembly in a gas turbine engine includes at least one premixer injector. The premixer injector includes a fuel tube having a fuel feed passage enclosed by an outer surface, a plurality of fins coupled to the fuel tube extending from the outer surface of the fuel feed passage, the outer surface of the fuel feed passage between adjacent fins having a concave shape, a plurality of mixing channels defined between adjacent fins, a plurality of fuel injection apertures disposed along the fuel feed passage to direct fuel from the fuel feed passage to the mixing channels, an air tube coupled to the fuel tube to at least partially enclose the fuel tube, and a plurality of air injection openings arranged along the air tube to inject air to the mixing channels.

20 Claims, 12 Drawing Sheets

(56) References Cited

U.S. PATENT DOCUMENTS

| | | | | |
|---|---|---|---|---|
| 10,443,854 | B2 * | 10/2019 | Grooms | F23R 3/286 |
| 2005/0155224 | A1 * | 7/2005 | Thompson | F02M 55/02 29/890.02 |
| 2009/0211256 | A1 * | 8/2009 | Williams | F02C 7/222 60/739 |
| 2009/0249789 | A1 * | 10/2009 | Zuo | F23R 3/286 60/746 |
| 2010/0011770 | A1 | 1/2010 | Chila et al. | |
| 2014/0238026 | A1 | 8/2014 | Boardman et al. | |

* cited by examiner

PREMIXER INJECTOR ASSEMBLY IN GAS TURBINE ENGINE

BACKGROUND

An industrial gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes.

The gas turbine engine may include premixer injectors for providing a mixture of air and fuel for the combustors. The premixer injectors need to effectively mix the air and fuel. The premixer injectors may also need to damp out thermoacoustic instability. Design of premixer injectors is a challenging task that needs to balance among the design criteria.

BRIEF SUMMARY

In one construction, a premixer injector assembly in a gas turbine engine, the premixer injector assembly comprising: a premixer injector having a first end and a second end opposite to the first end; a fuel tube having a first plate disposed at the first end, a second plate disposed at the second end, and a fuel feed passage enclosed by an outer surface and extending between the first plate and the second plate; a plurality of fins coupled to the fuel tube, the plurality of fins extending from the outer surface of the fuel feed passage and extending between the first plate and the second plate, the outer surface of the fuel feed passage between adjacent fins of the plurality of fins comprising a concave shape; a plurality of mixing channels, each mixing channel of the plurality of mixing channels defined between a pair of adjacent fins of the plurality of fins; a plurality of fuel injection apertures disposed along the fuel feed passage between the first plate and the second plate to direct fuel from the fuel feed passage to at least one mixing channel of the plurality of mixing channels; an air tube coupled to the fuel tube to at least partially enclose the fuel tube between the first end and the second end; and a plurality of air injection openings arranged along the air tube to inject air to the at least one mixing channel of the plurality of mixing channels.

In another construction, a premixer injector assembly in a gas turbine engine, the premixer injector assembly comprising: a plurality of premixer injectors assembled in at least one block, each premixer injector of the plurality of premixer injectors comprising: a fuel tube having a first plate, a second plate, and a fuel feed passage enclosed by an outer surface and extending between the first plate and the second plate; a plurality of fins coupled to the fuel tube, the plurality of fins extending from the outer surface of the fuel feed passage and extending between the first plate and the second plate, the outer surface of the fuel feed passage between adjacent fins of the plurality of fins comprising a concave shape, wherein at least a portion of each fin of the plurality of fins is twisted along the fuel tube forming a helical shape; a plurality of mixing channels, each mixing channel of the plurality of mixing channels defined between a pair of adjacent fins of the plurality of fins; a plurality of fuel injection apertures disposed along the fuel feed passage between the first plate and the second plate to direct fuel from the fuel feed passage to at least one mixing channel of the plurality of mixing channels; an air tube coupled to the fuel tube to at least partially enclose the fuel tube; and a plurality of air injection openings arranged along the air tube to inject air to the at least one mixing channel of the plurality of mixing channels.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
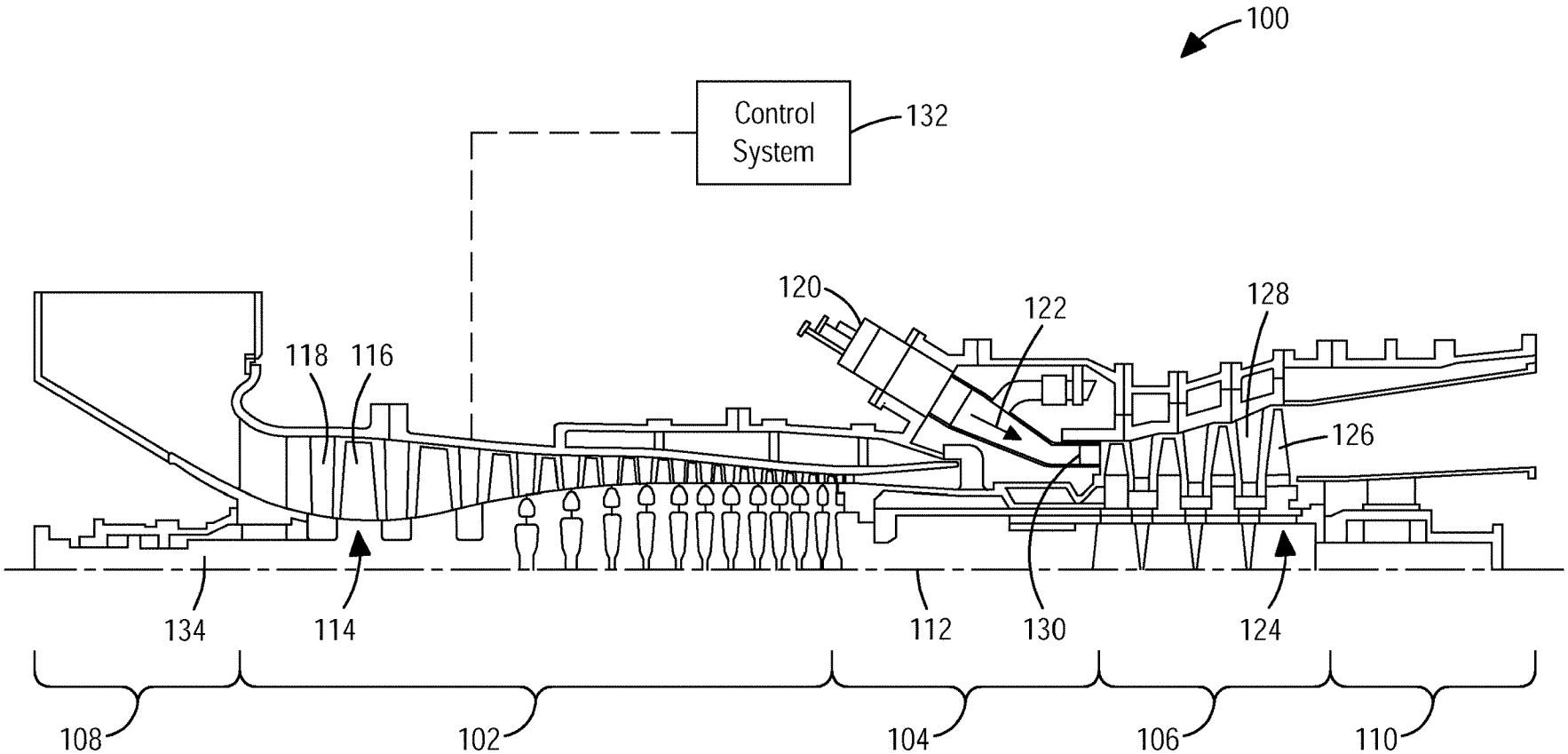
FIG. 1 is a longitudinal cross-sectional view of a gas turbine engine taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a central axis 112. The compressor section 102 includes a plurality of compressor stages 114 with each compressor stage 114 including a set of rotating blades 116 and a set of stationary vanes 118 or adjustable guide vanes. A rotor 134 supports the rotating blades 116 for rotation about the central axis 112 during operation. In some constructions, a single one-piece rotor 134 extends the length of the gas turbine engine 100 and is supported for rotation by a bearing at either end. In other constructions, the rotor 134 is assembled from several separate spools that are attached to one another or may include multiple disk sections that are attached via a bolt or plurality of bolts.

The compressor section 102 is in fluid communication with an inlet section 108 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120 that each operate to mix a flow of fuel with the compressed air from the compressor section 102 and to combust that air-fuel mixture to produce a flow of high temperature, high pressure combustion gases or exhaust gas 122. Of course, many other arrangements of the combustion section 104 are possible.

The turbine section 106 includes a plurality of turbine stages 124 with each turbine stage 124 including a number of rotating turbine blades 126 and a number of stationary turbine vanes 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 110 is positioned downstream of the turbine section 106 and is arranged to receive the expanded flow of exhaust gas 122 from the final turbine stage 124 in the turbine section 106. The exhaust portion 110 is arranged to efficiently direct the exhaust gas 122 away from the turbine section 106 to assure efficient operation of the turbine section 106. Many variations and design differences are possible in the exhaust portion 110. As such, the illustrated exhaust portion 110 is but one example of those variations.

A control system 132 is coupled to the gas turbine engine 100 and operates to monitor various operating parameters and to control various operations of the gas turbine engine 100. In preferred constructions the control system 132 is typically micro-processor based and includes memory devices and data storage devices for collecting, analyzing, and storing data. In addition, the control system 132 provides output data to various devices including monitors, printers, indicators, and the like that allow users to interface with the control system 132 to provide inputs or adjustments. In the example of a power generation system, a user may input a power output set point and the control system 132 may adjust the various control inputs to achieve that power output in an efficient manner.

The control system 132 can control various operating parameters including, but not limited to variable inlet guide vane positions, fuel flow rates and pressures, engine speed, valve positions, generator load, and generator excitation. Of course, other applications may have fewer or more controllable devices. The control system 132 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
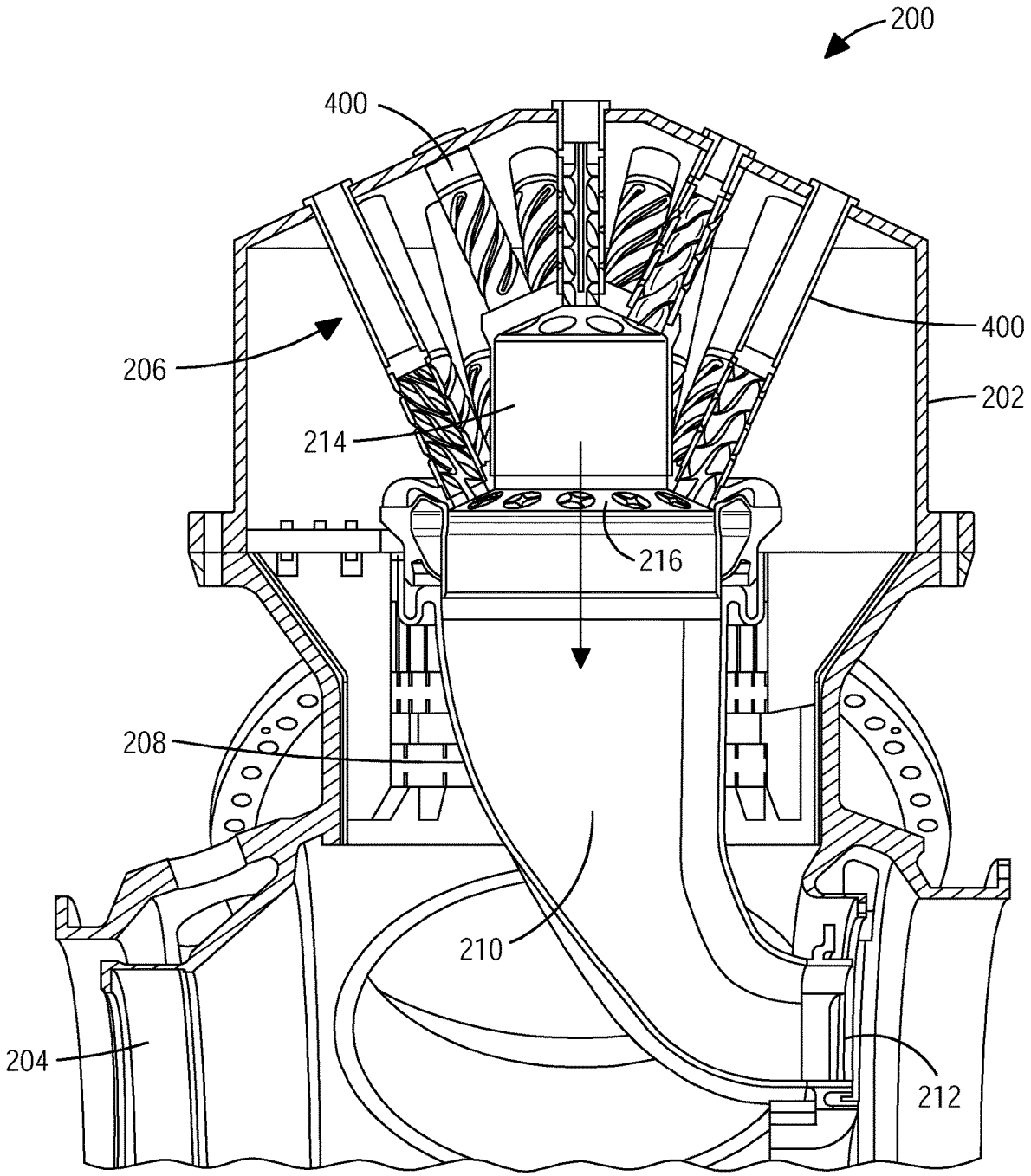
FIG. 2 illustrates a section view of a combustor in a combustion section.

FIG. 2 illustrates a section view of a combustor 200. The combustor 200 includes a casing 202, an inlet 204, a premixer injector assembly 206, a combustor liner 208 defining a combustor chamber 210 and a chamber exit 212. The casing 202 encloses the premixer injector assembly 206 and the combustor liner 208. The premixer injector assembly 206 is disposed upstream of the combustor chamber 210.

The premixer injector assembly 206 includes a plurality of premixer injectors 400. The premixer injectors 400 are assembled in at least one block. As illustrated in FIG. 2, a number of the premixer injectors 400 are assembled in a primary block 214 and a remaining number of the premixer injectors 400 are assembled in a secondary block 216. The primary block 214 is disposed upstream of the secondary block 216. The premixer injectors 400 are not parallel to each other. The premixer injectors 400 are oblique to the general flow direction indicated by the arrow. It is understood that the premixer injectors 400 may be assembled in the primary block 214 and secondary block 216 in other configurations, such as parallel to each other, or perpendicular to the primary block 214 or perpendicular to the secondary block 216.

In operation of the gas turbine engine 100, air from the compressor section 102 enters the combustor 200 through the inlet 204 and is injected to the premixer injectors 400. Fuel from a fuel source (not shown) enters the premixer injectors 400. Air and fuel are mixed in the premixer injectors 400. The mixture of air and fuel enters the combustor chamber 210, as indicated by the arrow line, and is ignited in the combustor chamber 210. The ignited mixture of air and fuel exits the combustor chamber 210 through the chamber exit 212 and enters the turbine section 106.

Figure 3:
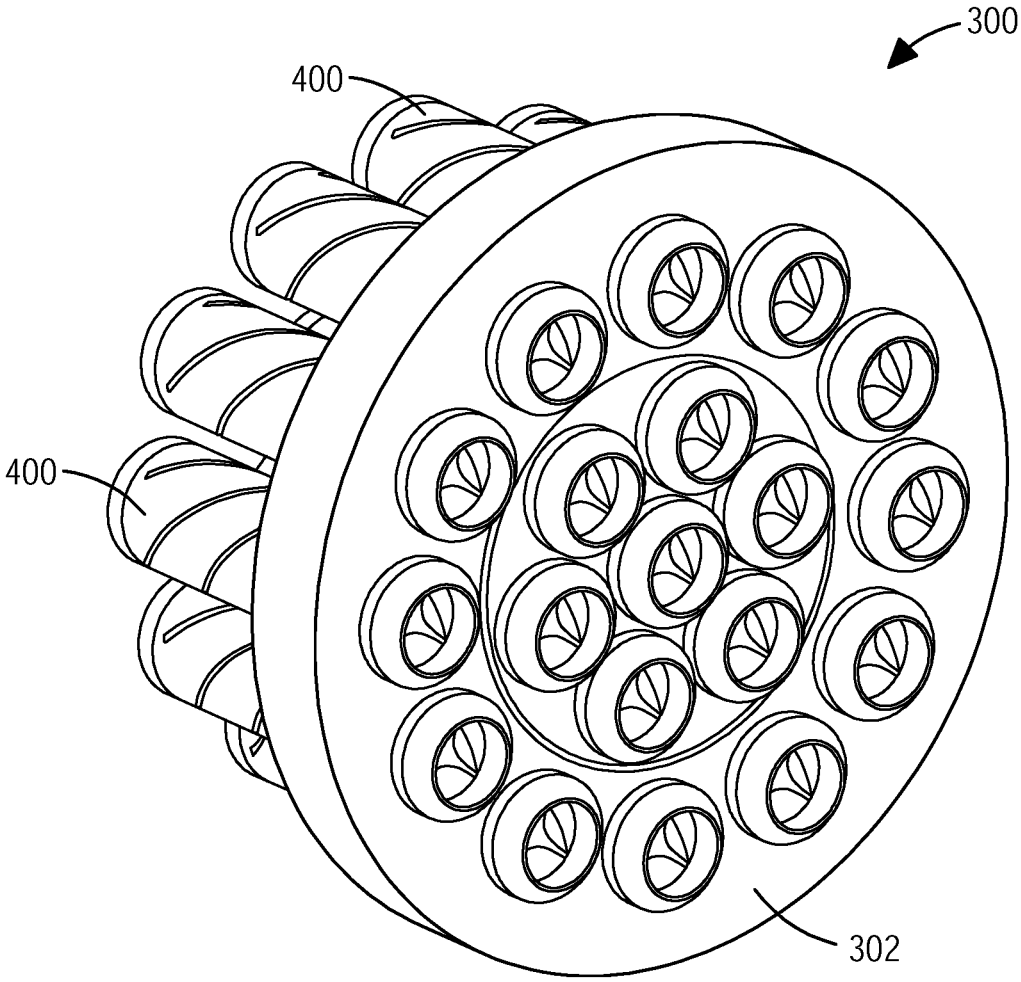
FIG. 3 illustrates a perspective view of a premixer injector assembly.

FIG. 3 illustrates a perspective view of a premixer injector assembly 300. The premixer injector assembly 300 includes a plurality of premixer injectors 400. As illustrated in FIG. 3, the plurality of premixer injectors 400 are all assembled in a single block 302. The plurality of premixer injectors 400 are parallel to each other. The plurality of premixer injectors 400 are perpendicular to the single block 302. The plurality of premixer injectors 400 are arranged in the single block 302 and spaced apart from each other. The plurality of premixer injectors 400 may be equally spaced apart from each other. The single block 302 has a circular shape. It is understood that the single block 302 may have other geometric shapes, such as oval, square, rectangular, etc. It is also understood that the plurality of premixer injectors 400 may be assembled in the single block 302 in other configurations, such as not parallel to each other, or not perpendicular to the single block 302, etc. The premixer injector assembly 300 shown in FIG. 3 is easy to assemble.

Figure 4:
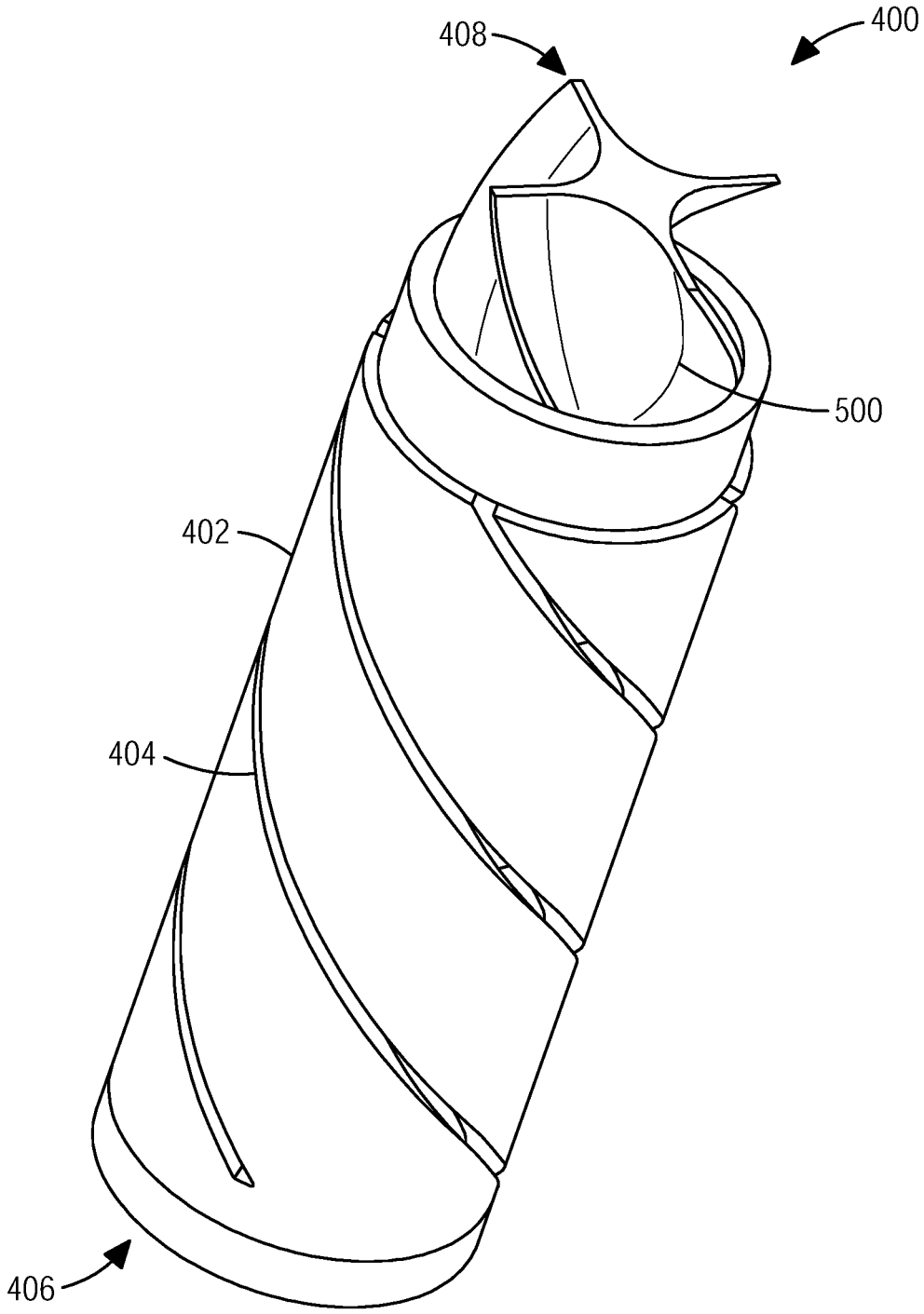
FIG. 4 illustrates a perspective view of a premixer injector.

FIG. 4 illustrates a perspective view of one of the premixer injectors 400 suitable for use in the arrangements illustrated in FIGS. 2-3. The premixer injector 400 has a first end 406 and a second end 408 opposite to the first end 406. The premixer injector 400 includes an air tube 402 and a fuel tube 500. The air tube 402 and the fuel tube 500 extend between the first end 406 and the second end 408. The air tube 402 at least partially encloses the fuel tube 500. A portion of the fuel tube 500 extends out of the air tube 402 at the second end 408. In other embodiments, the fuel tube 500 may also be recessed in the air tube 402. The air tube 402 and the fuel tube 500 may be manufactured as two separate components. The air tube 402 and the fuel tube 500 are then assembled together to form the premixer injector 400. The air tube 402 and the fuel tube 500 may be manufactured as a single component forming the premixer injector 400.

The air tube 402 includes at least one air injection opening 404 disposed along the air tube 402 and extending between the first end 406 and the second end 408. The air injection opening 404 perforates the air tube 402. The air injection opening 404 has a helical shape. The air injection opening 404 is twisted between the first end 406 and the second end 408 forming the helical shape. As shown in FIG. 4, the air injection opening 404 has a uniform width between the first end 406 and the second end 408. However, the air injection openings may be wider toward the first end 406 and narrower towards the second end 408 or vise verse.

The air tube 402 may include a plurality of air injection openings 404. As illustrated in FIG. 4, the air tube 402 includes four air injection openings 404. The four air injection openings 404 are arranged on the air tube 402 and are equally spaced apart from each other. Each of the four air injection openings 404 has a helical shape and is twisted between the first end 406 and the second end 408. The four air injection openings 404 are parallel to each other. However, the air injection openings 404 may not be parallel to each other. The air tube 402 may include any numbers of air injection openings 404, for example, two air injection openings 404, three air injection openings 404, five air injection openings 404, six air injection openings 404, etc.

Figure 5:
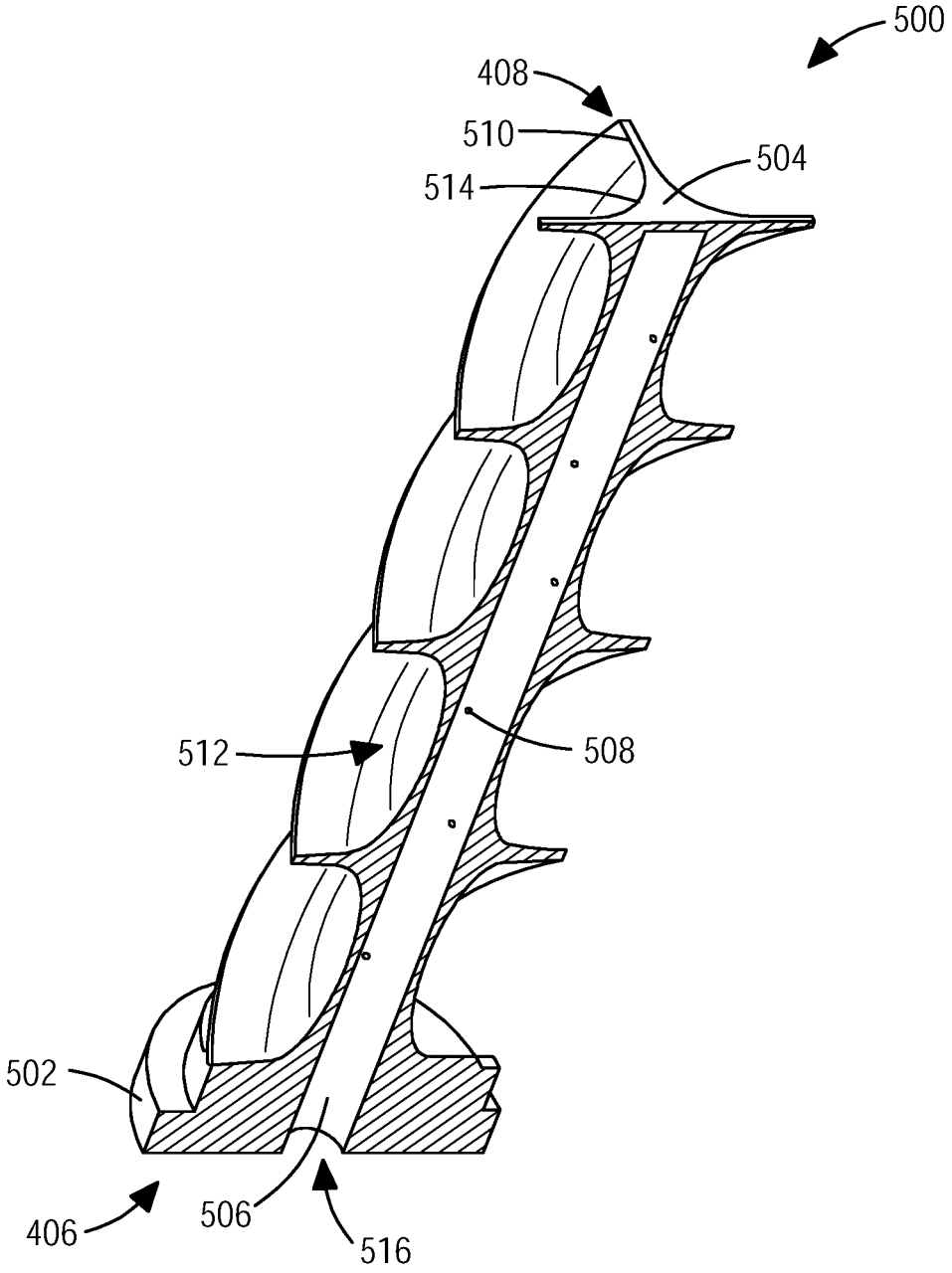
FIG. 5 illustrates a cutaway view of a fuel tube in accordance with FIG. 4.

FIG. 5 illustrates a cutaway view of the fuel tube 500 in accordance with FIG. 4. The fuel tube 500 includes a first plate 502 disposed at the first end 406, a second plate 504 disposed at the second end 408, and a fuel feed passage 506 extending between the first plate 502 and the second plate 504. The fuel feed passage 506 is enclosed by an outer surface 514. The first plate 502 has an orifice 516 to feed fuel from a fuel source (not shown) to the fuel feed passage 506.

The fuel tube 500 includes a plurality of fuel injection apertures 508 disposed along the fuel feed passage 506 between the first plate 502 and the second plate 504. The fuel injection apertures 508 perforate the outer surface 514 of the fuel feed passage 506 to direct the fuel out of the fuel feed passage 506.

The fuel tube 500 includes at least one fin 510 coupled to the fuel tube 500. The fin 510 extends outward from the outer surface 514 of the fuel feed passage 506. The fin 510 extends along the fuel tube 500 between the first plate 502 and the second plate 504. The fin 510 has a helical shape. The helical shaped fin 510 is twisted between the first plate 502 and the second plate 504.

Figure 6:
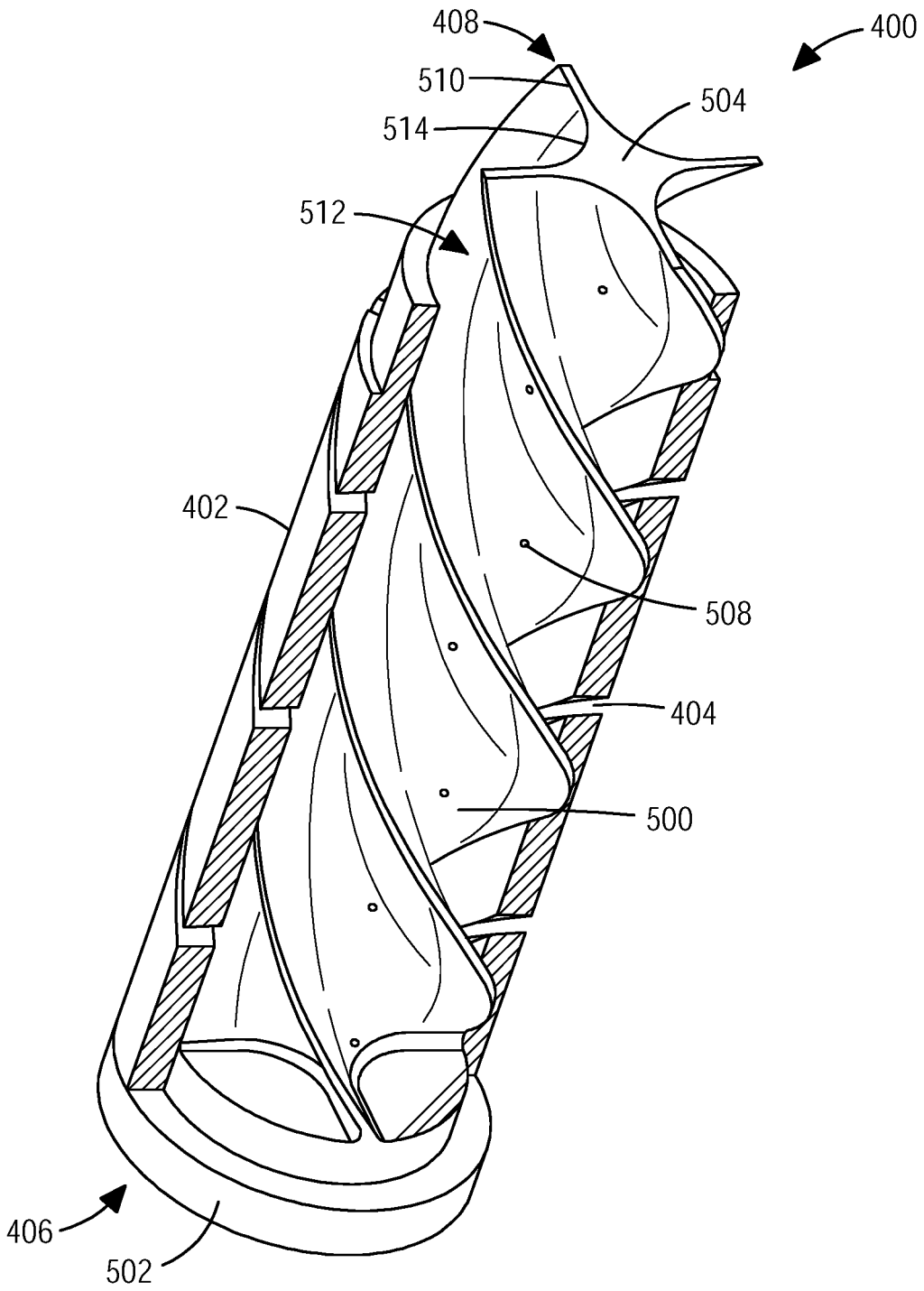
FIG. 6 illustrates a cutaway view of the premixer injector in accordance with FIG. 4.

The fuel tube 500 may include a plurality of fins 510. As illustrated in the cutaway view of FIG. 5, the fuel tube 500 includes four fins 510 (three fins 510 are visible in FIG. 5, four fins 510 are shown in FIG. 6). The four fins 510 are arranged on the outer surface 514 of the fuel feed passage 506 and are equally spaced apart from each other. Each of the four fins 510 has a helical shape and is twisted between the first plate 502 and the second plate 504. The four fins 510 are parallel to each other. However, the fins 510 may not be parallel to each other. The fuel tube 500 may include any numbers of fins 510, for example, two fins 510, three fins 510, five fins 510, or six fins 510, etc.

A mixing channel 512 is defined between a pair of adjacent fins 510. The outer surface 514 of the fuel feed passage 506 between adjacent fins 510 has a concave shape.

FIG. 6 illustrates a cutaway view of the premixer injector 400 in accordance with FIG. 4. The air tube 402 is cutaway to illustrate the fuel tube 500 disposed in the air tube 402.

The fuel tube 500 includes four fins 510 that each extend from the outer surface 514 of the fuel feed passage 506 to the air tube 402. Four mixing channels 512 are defined between four pairs of adjacent fins 510 and between the air tube 402 and the outer surface 514 of the fuel feed passage 506. The four mixing channels 512 are independent from each other and are separated by fins 510. The number of the fins 510 and the number of mixing channels 512 are designed to meet the requirement of the particular engine in which they are used. In preferred constructions, the number of fins 510 matches the number of air injection openings 404 and the helical twist of the fins 510 matches that of the air injection openings 404. Of course, other arrangements are possible.

In operation of the gas turbine engine 100, air from the compressor section 102 enters at least one mixing channel 512 through the air injection opening 404. Fuel from the fuel feed passage 506 is directed to at least one mixing channel 512 through the fuel injection apertures 508. The air and fuel are mixed in the mixing channel 512 and swirled in the mixing channel 512 along the helical shape of the fins 510. A swirl flow of the mixture of air and fuel is induced at the second end 408 of the premixer injector 400. A strength of the swirl flow of the mixture of air and fuel is defined by a tangential component of a velocity the mixture of air and fuel exiting the premixer injector 400. The strength of the swirl flow of the mixture of air and fuel is controlled by a twist angle of the helix of the fins 512. The swirl flow of the mixture of air and fuel is discharged directly to the combustor chamber 210.

In operation of the gas turbine engine 100, air may be unevenly fed to the premixer injector 400. For example, air may be preferably coming from the top of the air tube 402. The premixer injector 400 is designed such that for a given twist length of the air injection openings 404 along the air tube 402, if the twist angle of the air injection openings 404 is sufficiently high, all mixing channels 512 are exposed to the top and under fed side of the air injection openings 404. Thereby, all mixing channels 512 receive the same amount of air.

Parameters of the helix are designed to meet requirement of the swirl flow of the mixture of the air and fuel at entry of the combustor chamber 210. The parameters of the helix include a pitch of the helix, a twist angle of the helix, etc. For example, a twist angle of the fin 510 between the first plate 502 and the second plate 504 may be 90°, 180°, 360°, 450°, or any suitable angles, etc. A twist angle of the fin 510 may be the same as a twist angle of the air injection opening 404. A pitch of the fin 510 may be the same as a pitch of the air injection opening 404. It is understood that a twist angle of the fin 510 may be different from a twist angle of the air injection opening 404. It is also understood that a pitch of the fin 510 may be different from a pitch of the air injection opening 404. The fin 510 showed in FIG. 6 has a non-zero twist angle between the first plate 502 and the second plate 504 which results in a helical shape fin 510 between the first plate 502 and the second plate 504. However, the twist angle of the fin 510 could be zero which results in a straight shape fin 510 between the first plate 502 and the second plate 504.

Figure 7:
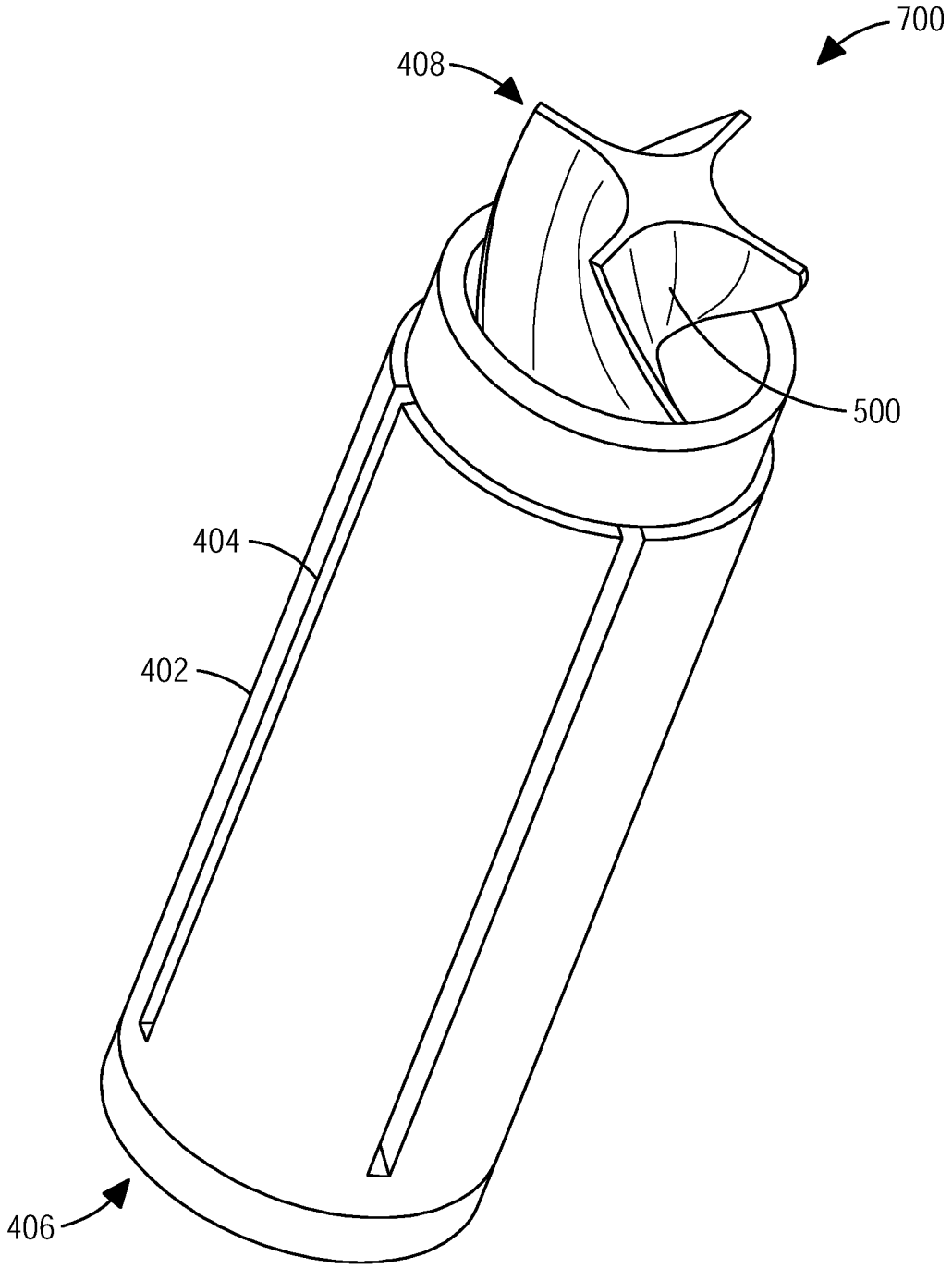
FIG. 7 illustrates a perspective view of a premixer injector in accordance with one embodiment.

FIG. 7 illustrates a perspective view of another premixer injector 700. The premixer injector 700 can be used in place of the premixer injector 400 or can be used in conjunction with the premixer injector 400.

The premixer injector 700 includes an air tube 402 and a fuel tube 500. The air tube 402 at least partially encloses the fuel tube 500. The premixer injector 700 has at least one air injection opening 404 disposed along the air tube 402 and extending between the first end 406 and the second end 408. The air injection opening 404 has a straight shape between the first end 406 and the second end 408.

The air tube 402 may include a plurality of air injection openings 404. As illustrated in FIG. 7, the air tube 402 includes four air injection openings 404 disposed along the air tube 402 and extending between the first end 406 and the second end 408. The four air injection openings 404 are arranged on the air tube 402 and are equally spaced apart from each other. Each of the four air injection openings 404 has a straight shape between the first end 406 and the second end 408. It is understood that the air tube 402 may include any numbers of air injection openings 404, for example, two air injection openings 404, three air injection openings 404, five air injection openings 404, six air injection openings 404, etc.

Figure 8:
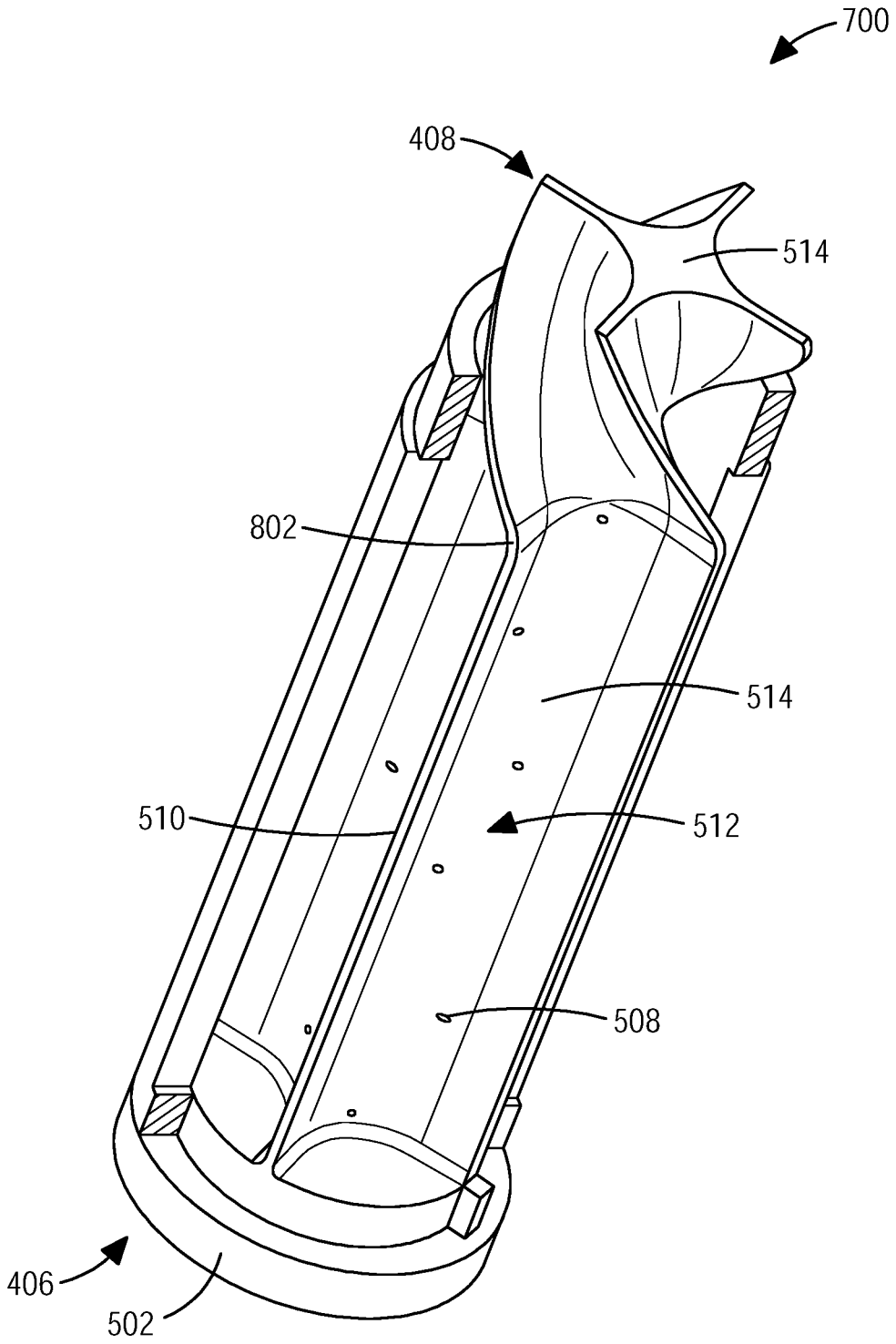
FIG. 8 illustrates a cutaway view of the premixer injector in accordance with FIG. 7.

FIG. 8 illustrates a cutaway view of the premixer injector 700 in accordance with FIG. 7. The fuel tube 500 includes a plurality of fuel injection apertures 508 disposed along the fuel feed passage 506 between the first plate 502 and the second plate 504. The fuel injection apertures 508 perforate the outer surface 514 of the fuel feed passage 506 to direct the fuel out of the fuel feed passage 506.

The fuel tube 500 includes at least one fin 510 coupled to the fuel tube 500. The fin 510 extends outward from the outer surface 514 of the fuel feed passage 506. The fin 510 extends between the first plate 502 and the second plate 504. The fin 510 has a straight shape between the first plate 502 to an intermediate point 802. The fin 510 is twisted between the intermediate point 802 and the second plate 504, thereby forming a helical shape. The intermediate point 802 is defined between the first plate 502 and the second plate 504. The intermediate point 802 may be disposed close to the second plate 504.

Parameters of the helix are designed to meet requirement of the swirl flow of the mixture of the air and fuel at an entry of the combustor 200. For example, the twist angle of the fin 510 between the intermediate point 802 and the second plate 504 may be 45°, 90°, 180°, 270°, or any suitable angles, etc.

The fuel tube 500 may include a plurality of fins 510. As illustrated in the cutaway view of FIG. 8, the fuel tube 500 includes four fins 510. The four fins 510 are arranged on the outer surface 514 of the fuel feed passage 506 and are equally spaced apart from each other. Each of the four fins 510 has a straight shape between the first plate 502 to the intermediate point 802 and is twisted between the intermediate point 802 and the second plate 504. It is understood that the fuel tube 500 may include any numbers of fins 510, for example, two fins 510, three fins 510, five fins 510, or six fins 510, etc.

A mixing channel 512 is defined between a pair of adjacent fins 510. The outer surface 514 between adjacent fins 510 has a concave shape. The concave shape includes a continuous curve that tangentially intersects each fin 510 of the adjacent fins 510 that defines the mixing channel 512. In another construction, the concave shape includes a single continuous curve that extends from a tip of one fin 510 to a tip of an adjacent fin 510 (e.g., a hyperbola). As illustrated in the cutaway view of FIG. 8, four mixing channels 512 are defined between four pairs of adjacent fins 510 and between the air tube 402 and the outer surface 514 of the fuel feed passage 506. The four mixing channels 512 are independent from each other and are separated by fins 510. The number of the fins 510 and the number of mixing channels 512 are designed to meet the requirement of the mixture at entry of the combustor chamber 210.

Figure 9:
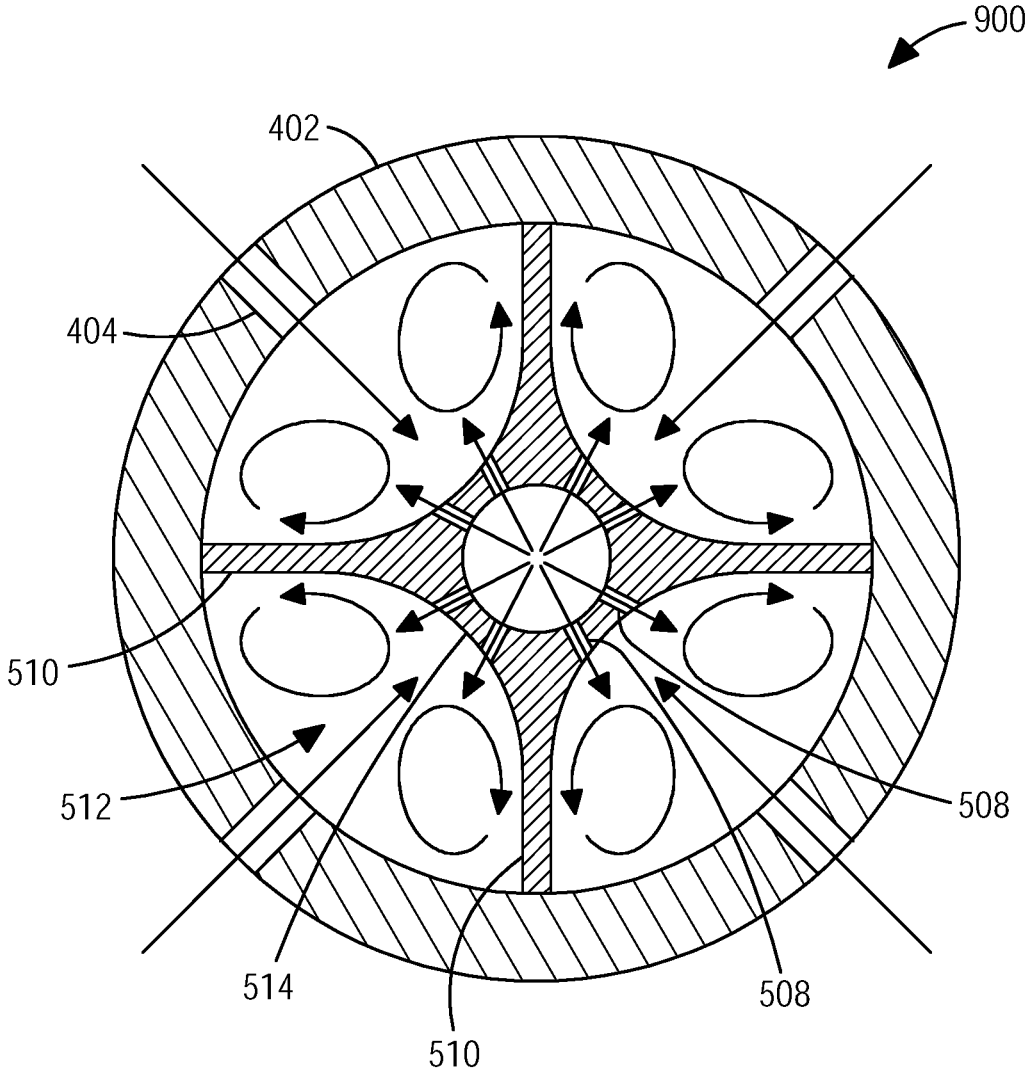
FIG. 9 illustrates a section view of a premixer injector in accordance with one embodiment.

FIG. 9 illustrates a section view of a premixer injector 900. The arrangement of the premixer injector 900 illustrated in FIG. 9 can be used in the premixer injector 400 or in the premixer injector 700.

Each air injection opening 404 is positioned between a pair of adjacent fins 510. The injection opening 404 is positioned along a center of one of the mixing channel 512 defined by the pair of adjacent fins 510. However, the air injection opening 404 could be positioned off-center of the mixing channel 512. For example, the air injection opening 404 could be positioned along the edge of one fin 510 of the pair of adjacent fins 510. FIG. 9 shows that the air injection opening 404 has a uniform width from an outer surface of the air tube 402 to an inner surface of the air tube 402. However, the air injection opening 404 may have a fillet on the outer surface of the air tube 402. The air injection opening 404 may have a tapered shape from the outer surface of the air tube 402 to the inner surface of the air tube 402. Air enters each mixing channel 512 through one air injection opening 404. Fuel enters each mixing channel 512 from the fuel feed passage 506 through two fuel injection apertures 508. As illustrated in FIG. 9, the fuel injection apertures 508 are perforated through the outer surface 514 of the fuel feed passage 506 in radial directions. However, it is understood that other arrangements are possible.

Air impinges on the outer surface 514 of the fuel feed passage 506 and creates a pair of counter-rotating vortices in each mixing channel 512. The pair of counter-rotating vortices mixes with the fuel in each mixing channel 512. Air and fuel are effectively mixed in each mixing channel 512. The mixture of air and fuel is discharged directly to the combustor chamber 210 with a swirl induced by the helical shaped fins 510.

A pair of counter-rotating vortices is created in each mixing channel 512. The outer surface 514 of the fuel feed passage 506 in which air is impinged on has a concave shape. The concave shaped impingement surface enables a stable flow configuration of the pair of counter-rotating vortices.

Figure 10:
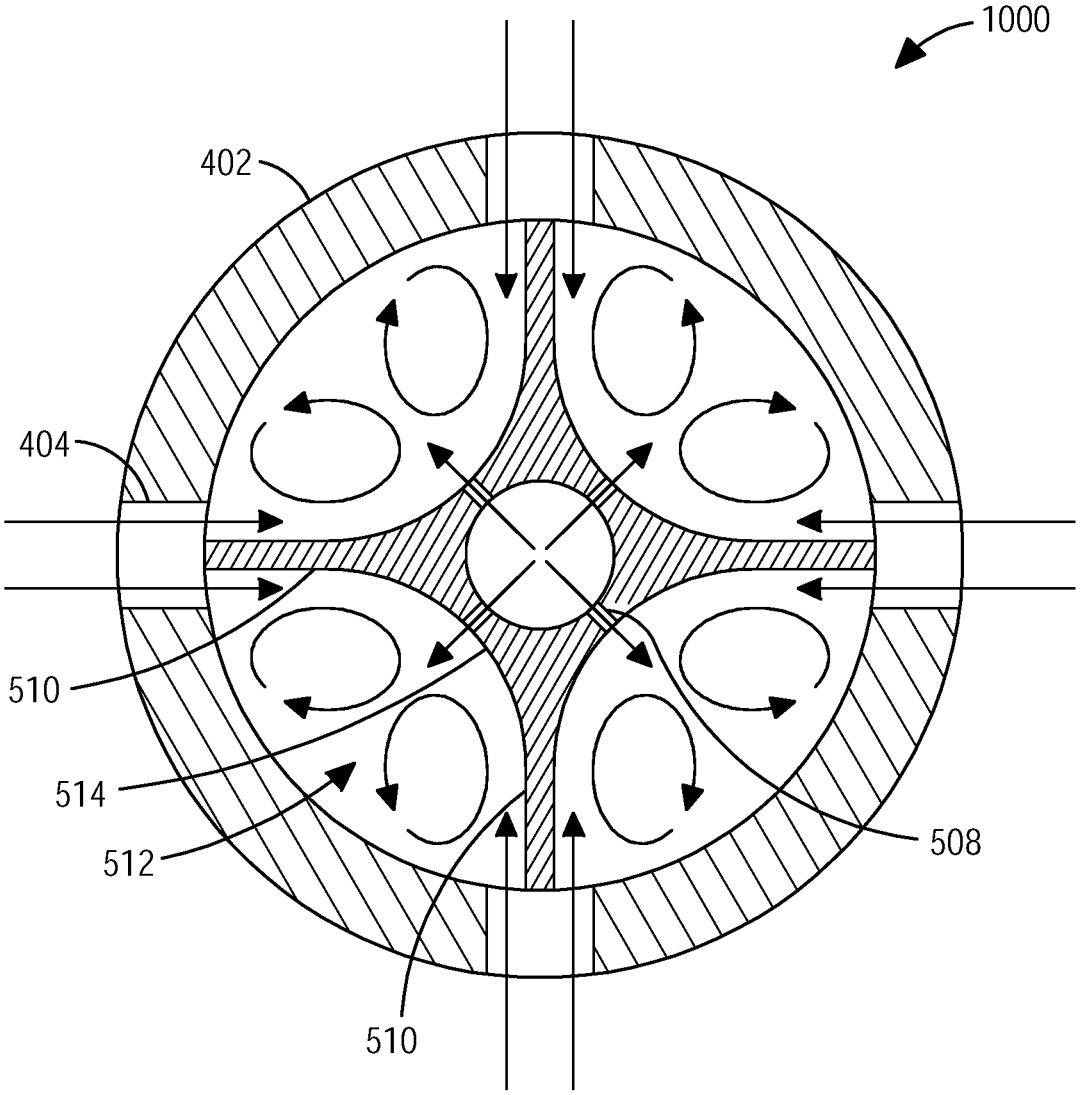
FIG. 10 illustrates a section view of a premixer injector in accordance with one embodiment.

FIG. 10 illustrates a section view of a premixer injector 1000. The arrangement of the premixer injector 1000 illustrated in FIG. 10 can be used in the premixer injector 400 or in the premixer injector 700.

Each air injection opening 404 is positioned along each fin 510 and is bisected by each fin 510. Air enters two adjacent mixing channels 512 through one bisected air injection opening 404. Of course, when using this arrangement, the air injection openings 404 are somewhat larger than those illustrated in the arrangement of FIG. 9 as the fin 510 effectively blocks a portion of the air injection opening 404. Fuel enters each mixing channel 512 from the fuel feed passage 506 through at least one fuel injection aperture 508. A pair of counter-rotating vortices is created in each mixing channel 512. FIG. 10 shows each air injection opening 404 is positioned along each fin 510 and is bisect by each fin 510. However, it could be understood that each air injection opening 404 is positioned along an alternative fin 510 and is bisect by the alternative fin 510.

Figure 11:
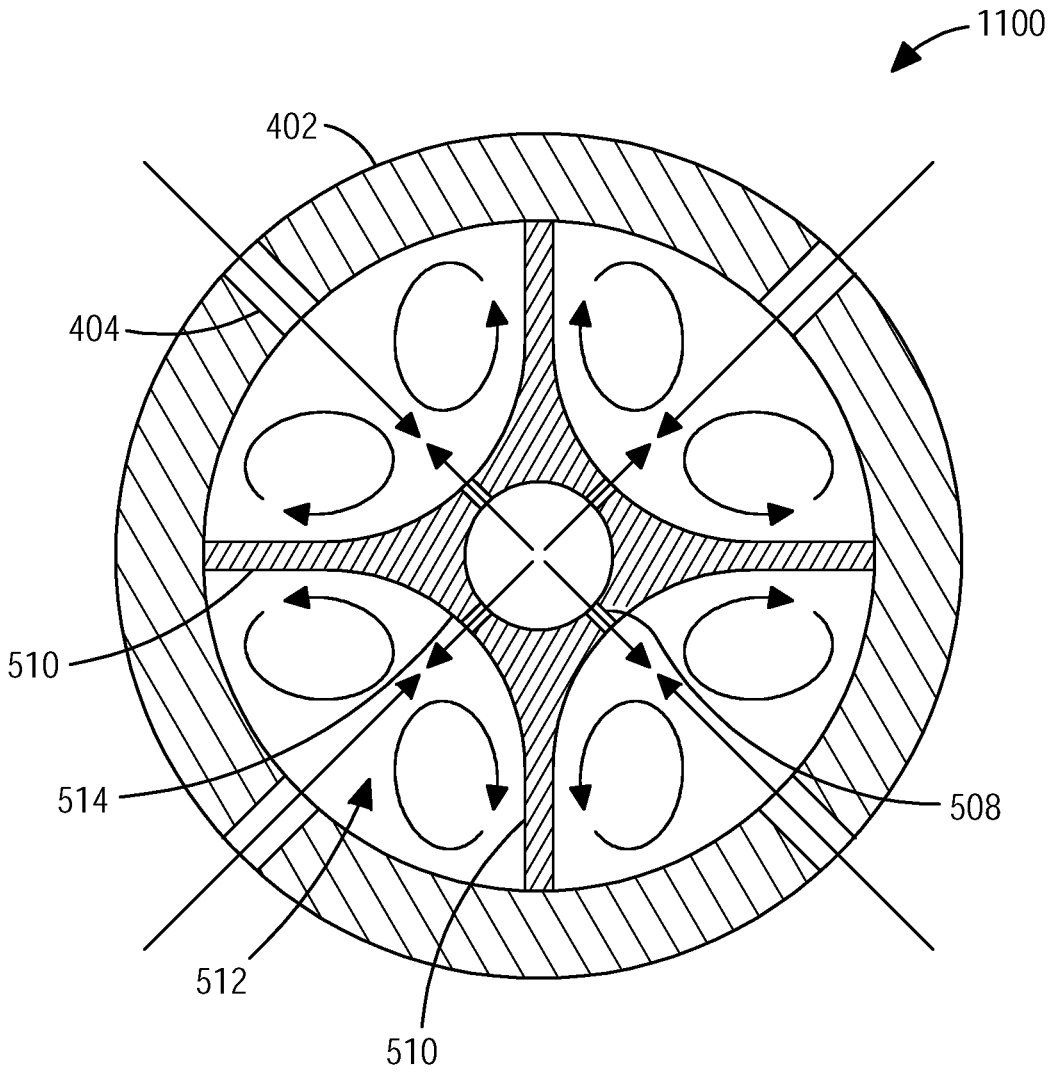
FIG. 11 illustrates a section view of a premixer injector in accordance with one embodiment.

FIG. 11 illustrates a section view of a premixer injector 1100. The arrangement of the premixer injector 1100 illustrated in FIG. 11 can be used in the premixer injector 400 or in the premixer injector 700.

Each air injection opening 404 is positioned between a pair of adjacent fins 512. The air injection opening 404 is positioned along a center of each mixing channel 512 defined by the pair of adjacent fins 510. However, the injection opening 404 could be positioned off-center of the mixing channel 512. Air enters each mixing channel 512 through one air injection opening 404. Fuel enters each mixing channel 512 from the fuel feed passage 506 through at least one fuel injection aperture 508. A pair of counter-rotating vortex is created in each mixing channel 512.

Figure 12:
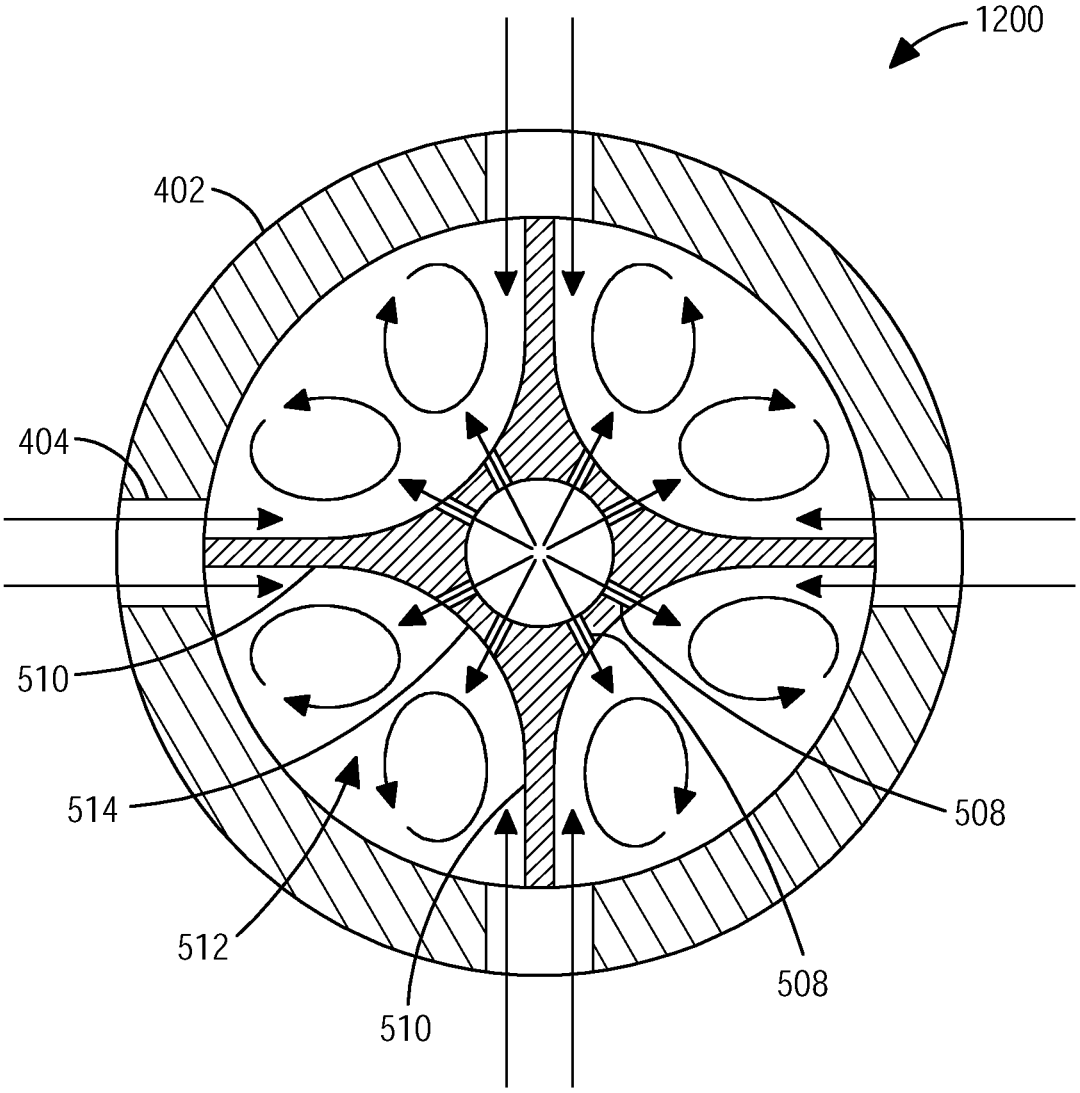
FIG. 12 illustrates a section view of a premixer injector in accordance with one embodiment.

FIG. 12 illustrates a section view of a premixer injector 1200. The arrangement of the premixer injector 1200 can be used in the premixer injector 400 or in the premixer injector 700.

Each air injection opening 404 is positioned along each fin 510 and is bisected by each fin 510. Air enters two adjacent mixing channels 512 through one bisected air injection opening 404. Fuel enters each mixing channel 512 from the fuel feed passage 506 through two fuel injection apertures 508. A pair of counter-rotating vortex is created in each mixing channel 512.

Configurations of the premixer injector 900, or the premixer injector 1000, or the premixer injector 1100, or the premixer injector 1200 may be combined by different configurations thereof. The premixer injector 400 or the premixer injector 700 may have any configuration of the premixer injector 900, the premixer injector 1000, the premixer injector 1100, or the premixer injector 1200, or any combinations thereof.

The premixer injectors 400 or the premixer injectors 700 effectively and rapidly mix air and fuel upstream of the combustor chamber 210 by a pair of stable counter-rotating vortices created in each mixing channel 512. The pair of stable counter-rotating vortices is created by the concave shaped outer surface 514 of the fuel feed passage 506. The effectively mixed air and fuel provide a uniform mixture composition to the combustor chamber 210. The premixer injector 400 or premixer injector 700 is robust against uneven air feeds which ensures the uniform mixture composition across the mixing channels 512. The uniform composition of the air and fuel reduces nitrogen oxides emissions from the combustor chamber 210.

The premixer injectors 400 or the premixer injectors 700 induce a swirl flow of the mixture of the air and fuel at the second end 408 of the premixer injector 400 or the premixer injector 700 to stabilize flames in the combustor chamber 210. The swirl flow of the mixture of the air and fuel is induced by the helical shaped fins 510 which may eliminate placing additional protruding swirler bodies downstream of the fuel injection apertures 508. The premixer injector 400 or premixer injector 700 provides a mixing channel 512 having an aerodynamic property that reduces low velocity zones in the mixing channel 512 due to boundary layers, wakes of the additional protruding swirler bodies, etc., which reduces occurrence of flashback and auto-ignition. The premixer injector 400 or premixer injector 700 provides a robust vortex-breakdown anchored flames for flame stability and turndown capability.

The air injection openings 404 and the fuel injection apertures 508 of the premixer injector 400 or the premixer injector 700 are arranged and distributed along the premixer injector 400 or the premixer injector 700. Air progressively enters the mixing channels 512 through the air injection openings 404 to damp fuel-air ratio fluctuations at an outlet of the premixer injector 400 or the premixer injector 700, which reduces thermo-acoustic instability in the combustion chamber 210. Fuel-air-ratio (FAR) muffling is thus achieved.

The premixer injector 400 or premixer injector 700 can use gas fuel or liquid fuel. The premixer injector 400 or premixer injector 700 can be fit with a diesel lane for direct lean injection of liquid fuel in the combustor chamber 210 which enables dry-liquid dual-fuel operation. The premixer injector 400 or premixer injector 700 can accommodate a variety of liquid fuel injectors, such as a plain jets in cross flow downstream of the premixer injector 400 or premixer injector 700, or close to outlet of the premixer injector 400 or premixer injector 700 to hide the liquid injection holes from the flame to reduce radiative heating and coking, or pressure-swirl atomizers, or any other configurations sufficiently small to be integrated within the tip of the premixer injector 400 or premixer injector 700. The liquid fuel can be injected in an upstream part of the fuel tube 500 to obtain lean-premixed flames in the combustor chamber 210.

The premixer injector 400 or premixer injector 700 is easy to manufacture and easy to assemble. The premixer injector 400 or premixer injector 700 can be scaled by numbers or geometrically or both to be used in different gas turbine engines which creates a commonality of component and cost reduction.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A premixer injector assembly in a gas turbine engine, the premixer injector assembly comprising:

a premixer injector having a first end and a second end opposite to the first end;

a fuel tube having a first plate disposed at the first end, a second plate disposed at the second end, and a fuel feed passage enclosed by an outer surface and extending between the first plate and the second plate;

a plurality of fins coupled to the fuel tube, the plurality of fins extending from the outer surface of the fuel feed passage and extending between the first plate and the second plate, the outer surface of the fuel feed passage between adjacent fins of the plurality of fins comprising a concave shape;

a plurality of mixing channels, each mixing channel of the plurality of mixing channels defined between a pair of adjacent fins of the plurality of fins;

a plurality of fuel injection apertures disposed along the fuel feed passage between the first plate and the second plate to direct fuel from the fuel feed passage to at least one mixing channel of the plurality of mixing channels;

an air tube coupled to the fuel tube to at least partially enclose the fuel tube between the first end and the second end; and a plurality of air injection openings arranged along the air tube to inject air to the at least one mixing channel of the plurality of mixing channels.

2. The premixer injector assembly of claim 1, wherein the concave shape comprises a continuous curve that tangentially intersects each fin of the adjacent fins.

3. The premixer injector assembly of claim 1, wherein each fin of the plurality of fins is twisted between the first plate and the second plate.

4. The premixer injector assembly of claim 1, wherein each air injection opening of the plurality of air injection openings is twisted between the first end and the second end.

5. The premixer injector assembly of claim 1, wherein each fin of the plurality of fins comprises a straight shape between the first plate to an intermediate point and is twisted between the intermediate point and the second plate.

6. The premixer injector assembly of claim 1, wherein each air injection opening of the plurality of air injection openings comprises a straight shape between the first end and the second end.

7. The premixer injector assembly of claim 1, wherein each air injection opening of the plurality of air injection openings is positioned between two adjacent fins of the plurality of fins.

8. The premixer injector assembly of claim 1, wherein each air injection opening of the plurality of air injection openings is positioned along one fin of the plurality of fins.

9. The premixer injector assembly of claim 1, wherein the plurality of fuel injection apertures direct the fuel to each mixing channel of the plurality of mixing channels, and wherein the plurality of air injection openings inject the air to each mixing channel of the plurality of mixing channels.

10. A premixer injector assembly in a gas turbine engine, the premixer injector assembly comprising:

a plurality of premixer injectors assembled in at least one block, each premixer injector of the plurality of premixer injectors comprising:

a fuel tube having a first plate, a second plate, and a fuel feed passage enclosed by an outer surface and extending between the first plate and the second plate;

a plurality of fins coupled to the fuel tube, the plurality of fins extending from the outer surface of the fuel feed passage and extending between the first plate and the second plate, the outer surface of the fuel feed passage between adjacent fins of the plurality of fins comprising a concave shape, wherein at least a portion of each fin of the plurality of fins is twisted along the fuel tube forming a helical shape;

a plurality of mixing channels, each mixing channel of the plurality of mixing channels defined between a pair of adjacent fins of the plurality of fins;

a plurality of fuel injection apertures disposed along the fuel feed passage between the first plate and the second plate to direct fuel from the fuel feed passage to at least one mixing channel of the plurality of mixing channels;

an air tube coupled to the fuel tube to at least partially enclose the fuel tube; and a plurality of air injection openings arranged along the air tube to inject air to the at least one mixing channel of the plurality of mixing channels.

11. The premixer injector assembly of claim 10, wherein the concave shape comprises a continuous curve that tangentially intersects each fin of the adjacent fins.

12. The premixer injector assembly of claim 10, wherein each fin of the plurality of fins is twisted between the first plate and the second plate.

13. The premixer injector assembly of claim 10, wherein each air injection opening of the plurality of air injection openings is twisted between the first end and the second end.

14. The premixer injector assembly of claim 10, wherein each fin of the plurality of fins comprises a straight shape between the first plate to an intermediate point and is twisted between the intermediate point and the second plate.

15. The premixer injector assembly of claim 10, wherein each air injection opening of the plurality of air injection openings comprises a straight shape between the first end and the second end.

16. The premixer injector assembly of claim 10, wherein each air injection opening of the plurality of air injection openings is positioned between two adjacent fins of the plurality of fins.

17. The premixer injector assembly of claim 10, wherein each air injection opening of the plurality of air injection openings is positioned along one fin of the plurality of fins.

18. The premixer injector assembly of claim 10, wherein the plurality of fuel injection apertures direct the fuel to each mixing channel of the plurality of mixing channels, and wherein the plurality of air injection openings inject the air to each mixing channel of the plurality of mixing channels.

19. The premixer injector assembly of claim 10, wherein the plurality of premixer injectors are all assembled in a single block.

20. The premixer injector assembly of claim 10, wherein a first quantity of the plurality of premixer injectors are assembled in a primary block and a second quantity of the plurality of premixer injectors are assembled in a secondary block.

* * * * *